United States Patent [19]

Stog

[11] 4,334,963

[45] Jun. 15, 1982

[54] EXHAUST HOOD FOR UNLOADING ASSEMBLY OF COKE-OVEN BATTERY

[75] Inventor: Wilhelm Stog, Waltrop, Fed. Rep. of Germany

[73] Assignee: WSW Planungs-GmbH, Waltrop, Fed. Rep. of Germany

[21] Appl. No.: 182,651

[22] Filed: Aug. 29, 1980

[30] Foreign Application Priority Data

Sep. 26, 1979 [DE] Fed. Rep. of Germany ..... 2938893
Dec. 22, 1979 [DE] Fed. Rep. of Germany ..... 2952179

[51] Int. Cl.[3] ..... C10B 33/00; C10B 33/14
[52] U.S. Cl. ..... 202/263
[58] Field of Search ..... 202/227, 263; 201/39; 414/152, 154, 155

[56] References Cited

U.S. PATENT DOCUMENTS

| | | | |
|---|---|---|---|
| 3,676,305 | 7/1972 | Cremer | 202/263 |
| 3,715,282 | 2/1973 | Pries et al. | 202/263 |
| 3,767,536 | 10/1973 | Ikeda et al. | 202/263 |
| 3,772,155 | 11/1973 | Knappstein | 202/263 |
| 3,809,622 | 5/1974 | Knappstein et al. | 202/263 |
| 3,844,900 | 10/1974 | Schulte | 202/263 X |
| 3,868,309 | 2/1975 | Sustarsic et al. | 202/263 X |
| 3,981,778 | 9/1976 | Schulte et al. | 202/263 |
| 4,019,963 | 4/1977 | Hanley, Jr. | 202/263 |
| 4,186,057 | 1/1980 | Schulte et al. | 202/227 X |
| 4,211,612 | 7/1980 | Stog | 202/263 |

FOREIGN PATENT DOCUMENTS

| | | |
|---|---|---|
| 1771506 | 5/1968 | Fed. Rep. of Germany . |
| 2842655 | 4/1980 | Fed. Rep. of Germany . |

*Primary Examiner*—Bradley Garris
*Attorney, Agent, or Firm*—Karl F. Ross

[57] ABSTRACT

An exhaust hood connectable with an unloading carriage during juxtaposition thereof with a coking chamber and designed to overlie a quenching wagon alongside that carriage has walls converging upward to a roof having two ducts rising from its front and rear ends, these ducts merging into a substantially centrally positioned vertical flue with an inserted dust filter and a downward extension forming a normally closed bunker for the reception of solids dislodged from the filter by periodic vibration thereof. A bypass is formed by a branch of the flue which can be linked during unloading with a pipe atop the juxtaposed carriage having an intake end above the region of the coking-chamber door to pick up waste gases escaping there. The hood may be supported by an ancillary guide track and an overhanging shelf on the side of the quenching wagon opposite the carriage track; alternatively, it is guided at one end on lateral rails of the quenching wagon and at its other end by an outrigger riding the track of that wagon, possibly in front of an engine towing same.

10 Claims, 6 Drawing Figures

EXHAUST HOOD FOR UNLOADING ASSEMBLY OF COKE-OVEN BATTERY

FIELD OF THE INVENTION

My present invention relates to an unloading assembly for a coke-oven battery wherein a quenching wagon receives a charge of red-hot coke from a coking chamber, usually by way of an unloading carriage, in order to transport it to a quenching station.

BACKGROUND OF THE INVENTION

In such an assembly it is customary to provide a hood which overlies the quenching wagon in its unloading position in order to catch the rising waste gases and lead them to a filtering or dedusting device separating entrained solids therefrom. While the charge is being pushed out of a coking chamber into the unloading carriage aligned therewith, the hood is connected with that carriage via a substantially airtight lateral channel traversed by a carbonaceous mass and the accompanying gases. In a conventional system, e.g. as described in German published specification (Offenlegungsschrift) No. 22 11 571, the waste gases are fed to a fixed wet-filtering unit via a stationary manifold to which the hood outlet must be tightly attached during unloading; the dedusting device described in that published specification includes a set of liquid filters. Another type of filter, formed by a heat-resistant cloth, is described in German patent application No. 28 42 655.3; according to that application, the cloth is periodically set in vibration for dislodging the intercepted solids which fall back onto the glowing coke bed. In this latter system, too, the exhaust gases are fed—after prefiltering—by way of a manifold to a central dedusting device with the aid of a suitably dimensioned blower.

OBJECTS OF THE INVENTION

An object of my present invention is to provide means on such a hood for filtering the evolving waste gases and exhausting them in a purified state into the atmosphere without the need for a central filtering or dedusting device having a manifold to which the hood outlet must be laboriously connected.

A more particular object of my invention is to provide means for also picking up waste gases escaping from an unavoidable clearance separating the wall of a coking chamber from the unloading carriage confronting its door opening during the push-out of the charge.

A further object of my present invention is to provide means for enabling the hood to accompany the quenching wagon on its way from its unloading position aligned with a coking chamber to a quenching station and to allow the wagon to enter the tower of that station without the hood so as to expose the coke bed to irrigation.

SUMMARY OF THE INVENTION

An exhaust hood embodying my invention, adapted to be coupled via a lateral channel to an unloading carriage on a first track and designed to overlie a quenching wagon riding on a generally lower second track, is displaceable above the latter track and arrestable in line with a coking chamber for the transfer of a charge from that chamber through the unloading carriage to the quenching wagon as described above. An open-topped flue, rising above the hood, forms a junction with one or more ducts extending from the top of the hood and is provided with a dry dust filter disposed therein above that junction; a downward extension of the flue forms a bunker below the junction for receiving solids intercepted by the dust filter, this extension having a normally closed bottom outlet openable to discharge accumulated solids. The bunker, advantageously, is of sufficient capacity to store dust particles accumulated over an entire 24-hour period so as to require emptying only once a day.

Pursuant to a more particular feature of my invention, the duct or ducts may be generally S-shaped in a vertical plane with steeply rising extremities and interconnected by a more nearly horizontal intermediate portion whereby larger chunks of solid material drop back onto the underlying coke bed while the smaller dust particles rise into the flue for interception by the filtering means. Upon being dislodged therefrom, as by a periodically activated vibrator, they descend into the bunker directly below and are thus segregated from coarser fractions so as to be utilizable for special purposes, e.g. as admixtures for a mass of solid particles to be transported in a sludge through a pipeline.

Since there are generally no obstructions above the track of a quenching wagon in a coking plant, the flue above the hood can be a stack of any suitable height.

In accordance with another advantageous feature of my invention, the hood is provided with a bypass extending in the unloading position above the carriage between the flue and an intake which overlies the aforementioned virtually unavoidable clearance between the carriage and the coking chamber. I prefer to divide that bypass into two separable parts which are respectively secured to the hood and to the carriage and which are interconnected only during unloading. If the updraft of the flue is insufficient to exhaust the waste gases evolving under the hood, a small blower may be installed above the filtering section; with or without such blower the main gas flow will create suction in the bypass according to Pitot's principle. The blower, in any case, need not be of large capacity and will be subjected to little wear since it handles only gases already purified.

For the guidance of the hood along the path of the quenching wagon I may provide ancillary track means on the side of the aforementioned second track opposite the first track supporting the unloading carriage, the ancillary track means advantageously comprising a rail below the level of the roof of the hood and an overhanging shelf above that level which are respectively engaged from above and from below by a first and a second set of rollers. An even simpler solution, eliminating the need for such a guide structure, resides according to a further feature of my invention in the provision of wheel-guiding means on the quenching wagon over which the hood can be displaced by a first wheel base supported at one of its ends, the opposite end of the hood supporting a second wheel base engaging the track of the quenching wagon itself. When the quenching wagon is externally driven by an engine riding the same track, the support for this second wheel base may be a cantilevered extension of the hood overreaching the engine so that the wheels of that base engage this track at a location separated by the engine from the quenching wagon.

BRIEF DESCRIPTION OF THE DRAWING

The above and other features of my invention will now be described in detail with reference to the accompanying drawing in which.

SPECIFIC DESCRIPTION

Figure 1:
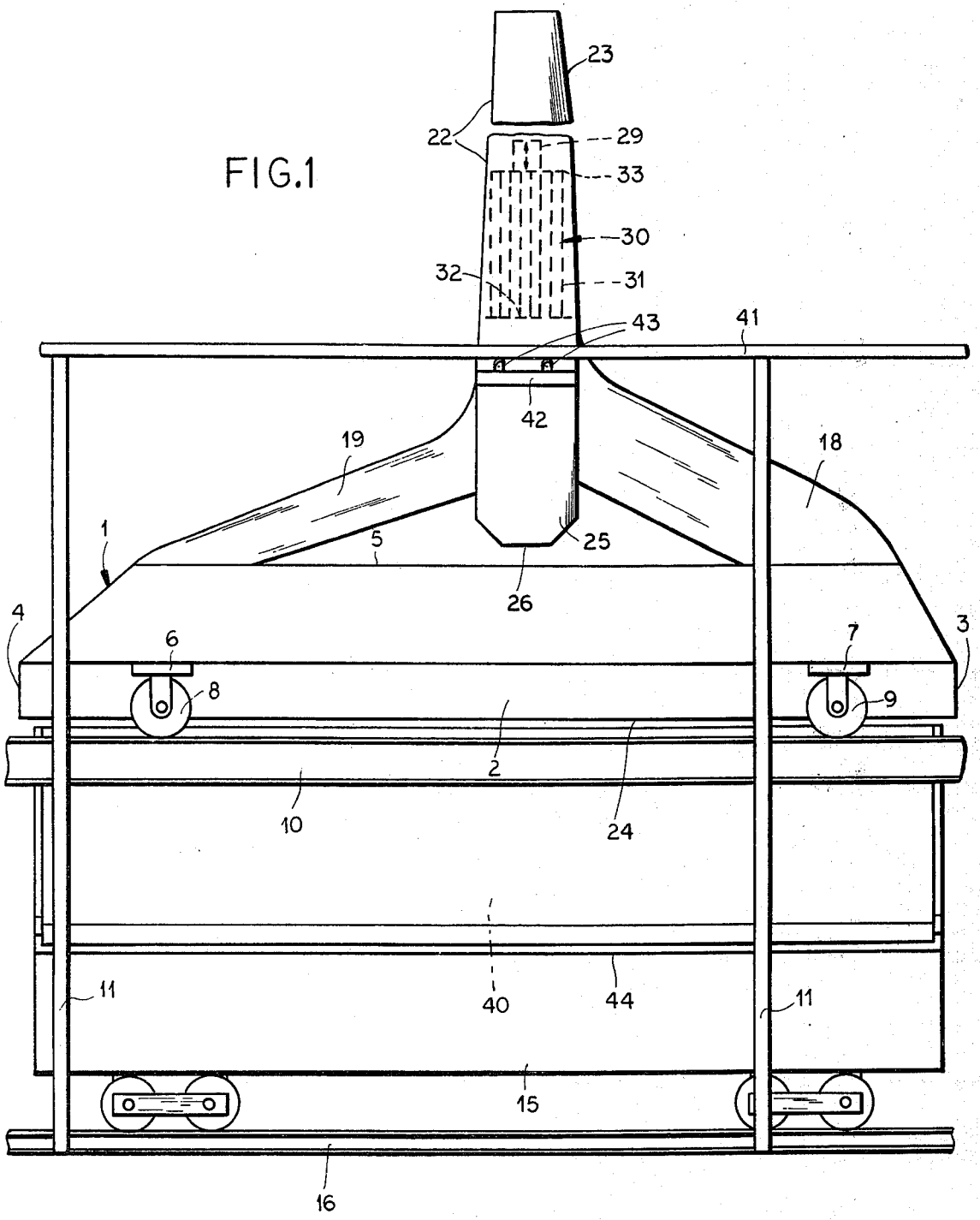
FIG. 1 is a side-elevational view of a quenching wagon positioned underneath an exhaust hood embodying my invention.
Figure 2:
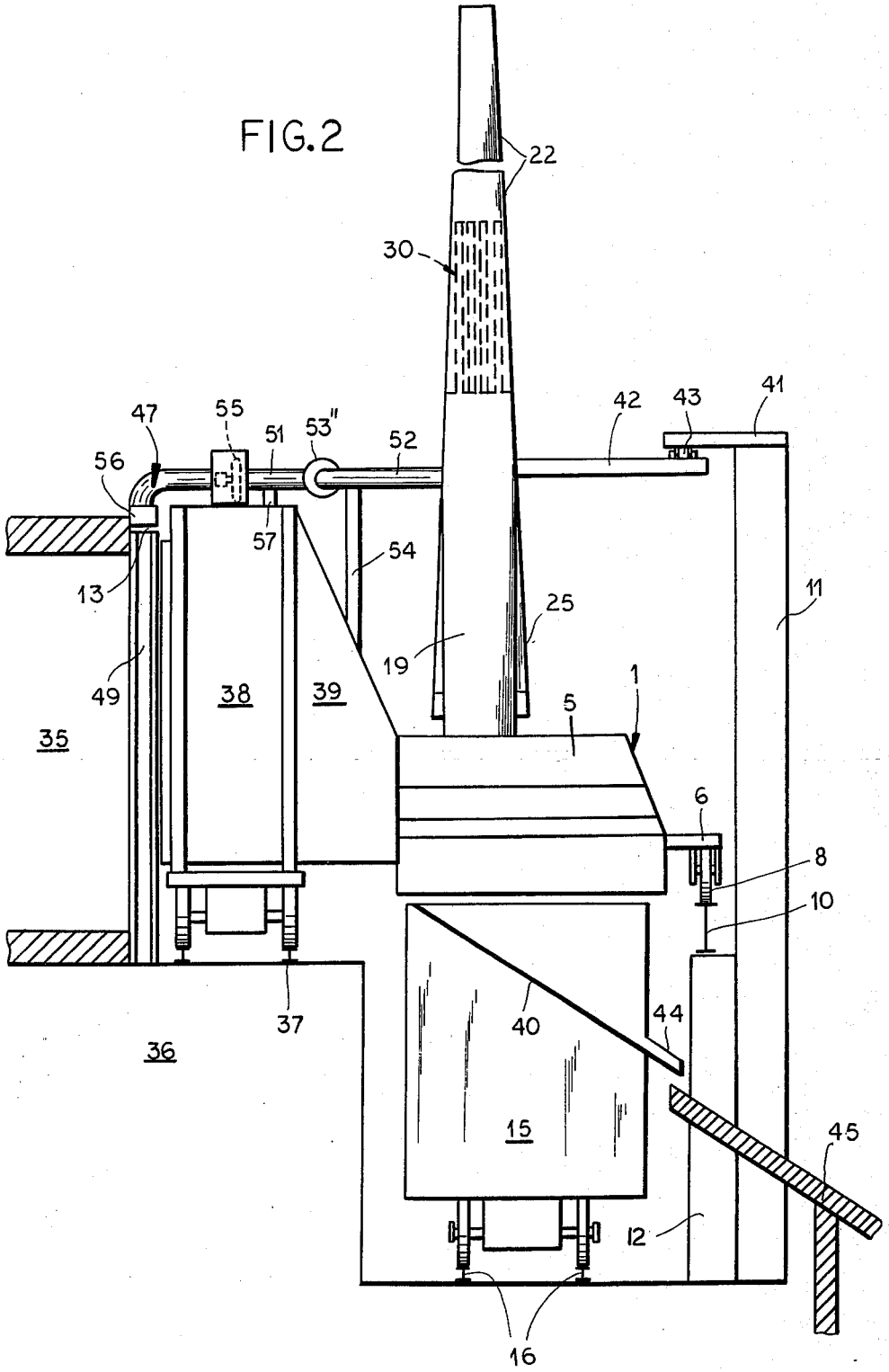
FIG. 2 is an end view of the assembly of FIG. 1, also showing an unloading carriage juxtaposed with a coking chamber and linked with the hood through a lateral channel.
Figure 3:
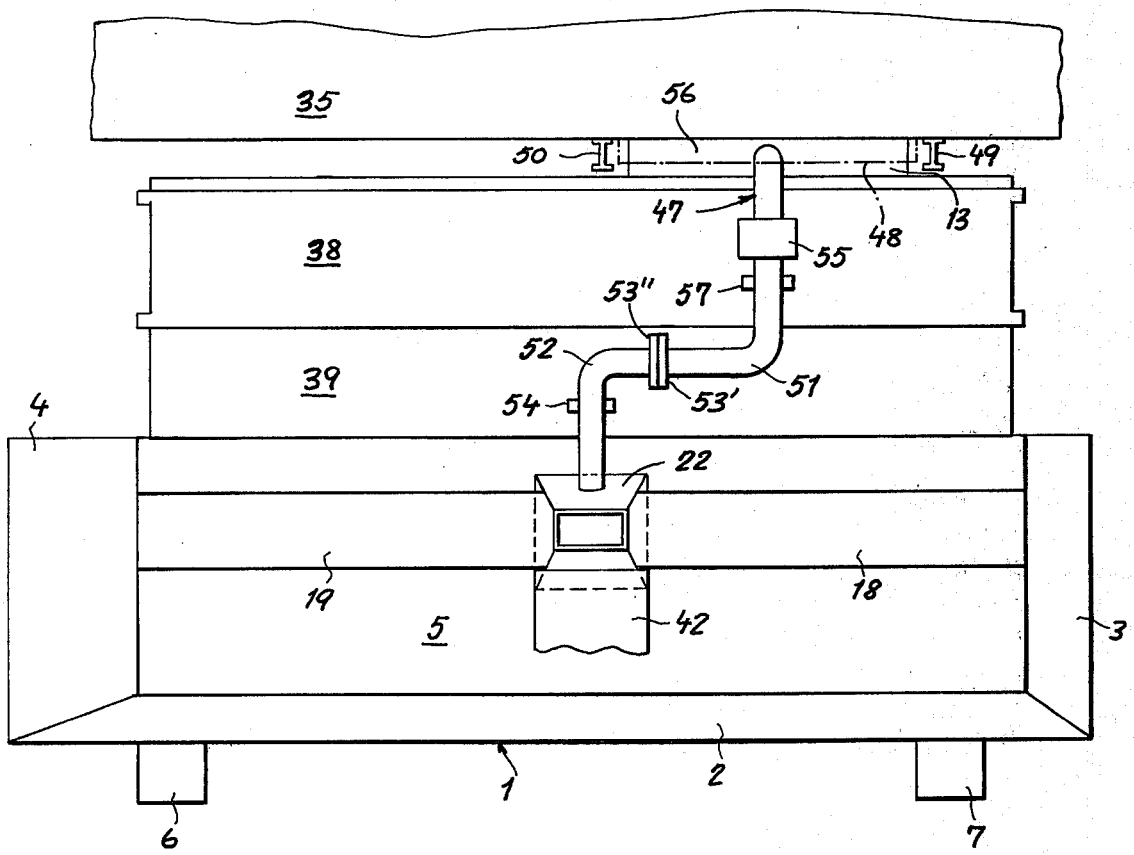
FIG. 3 is a fragmentary top view of the assembly of FIGS. 1 and 2.

In FIGS. 1–3 I have shown an exhaust hood 1 with side and end walls 2, 3, 4 converging upward toward a roof 5 of generally rectangular outline, the hood overlying completely a quenching wagon 15 which in FIGS. 2 and 3 is shown juxtaposed with an unloading carriage or transfer car 38 and a coking chamber 35 forming part of a coke-oven battery of conventional type. Carriage 38 rides on rails 37 of a first or main track supported on a pedestal 36 whereas wagon 15 rides on rails 16 of a secondary track at a lower level. Brackets 6, 7 on hood 1 support a pair of rollers or wheels 8, 9 engaging a rail 10 of a third track which also includes a shelf 41 overhanging an arm 42 of the hood carrying rollers 43. Shelf 41 is mounted on posts 11 with attachments 12 which support the rail 10. Arm 42 is secured to a flue or stack 22 which in turn is supported above the roof 5 of hood 1 by a pair of generally S-shaped ducts 18 and 19 rising from opposite ends of that roof and merging with the flue at a junction above which the flue is internally provided with a filtering unit 30 extending over a limited section of its height; unit 30, which should be designed as an insert extractable through a nonillustrated door, is shown equipped with an intermittently activable vibrator 29 serving to dislodge intercepted solid particles from the walls of the filtering elements and to let them drop into a downward extension 25 of flue 22 forming a bunker with a normally closed bottom outlet 26. The filtering elements of unit 30 may be vertical portions 31 of filter cloth meandering between perforated lower and upper end plates 32 and 33 to form a multiplicity of downwardly open pockets; such a cloth is usually woven from metallic filaments enveloped by textile fibers or other organic material. The filter could also be designed as a series of horizontal, vertically separated eggcrate-type gratings as disclosed in my copending application Ser. No. 120,104 filed Feb. 8, 1980. The flue 22 will be seen to converge toward its open top 23.

While the lower rim 24 of hood 1 extends sufficiently beyond the outline of wagon 15 to draw in virtually all the waste gases evolving from a glowing coke bed piled up on the sloping bottom 40 of that wagon, it may be necessary to pick up also those gases which escape from a clearance 13 between the unloading carriage 38 and the adjoining coking chamber 35, that clearance resulting from the presence of a guide frame whose jambs 49, 50 are shown in FIG. 3 and which serves for the removal of a chamber door 48. For this purpose I prefer to provide a bypass, generally designated 47, which comprises two complementary pipe sections 51, 52 terminating in respective flanges 53', 53'' by which they may be coupled together when the hood 1 has been connected with the carriage 38 by way of a channel 39. Pipe section 51, which has an intake end 56 extending over nearly the full width of door 48, is supported on the carriage through a mounting 57; pipe section 52, constituting a branch of flue 22, temporarily rests in the coupling position on a cradle 54 atop the carriage. FIG. 3 also shows an auxiliary fan 55 in section 51 designed to supplement the suction generated by the updraft in flue 22; that updraft, as already noted, may be intensified with the aid of another blower or fan inside the flue as shown at 109 in FIGS. 4–6. The roller-carrying arm 42 could also be mounted on the hood itself, with lowering of shelf 41, yet the illustrated positioning of the counterbearing 41–43 at an elevated level increases the stability of the hood and its attachments.

FIG. 2 also shows a chute 44 forming an extension of the bottom 40 of wagon 15 from which the coke, after quenching, can be discharged over a stationary ramp 45.

Figure 4:
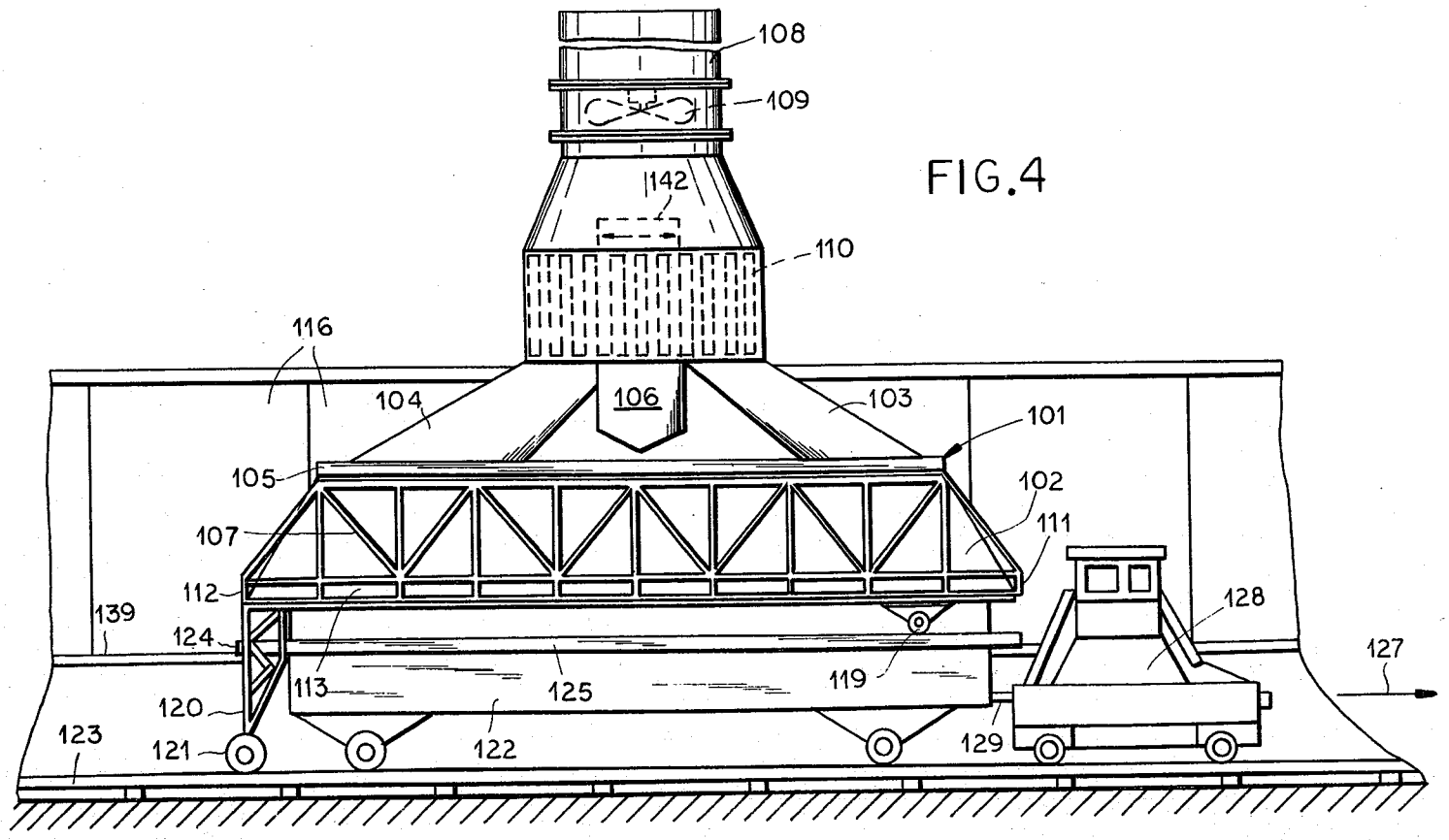
FIG. 4 is a view similar to FIG. 1, illustrating another embodiment.
Figure 6:
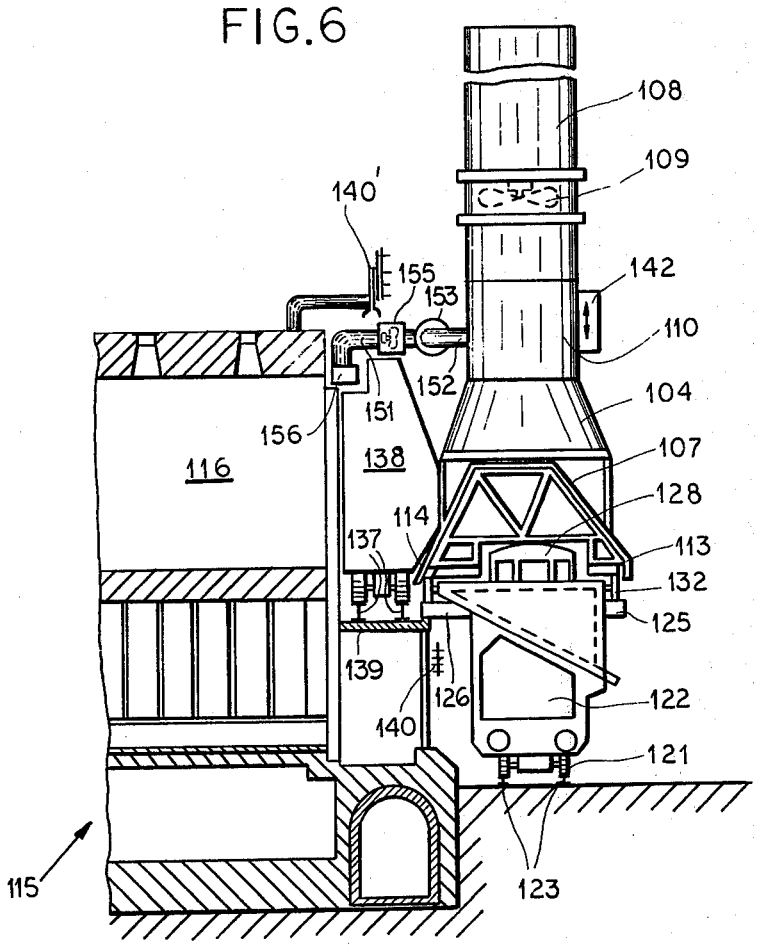
FIG. 6 is an end view of the assembly illustrated in FIG. 5.

The embodiment of FIG. 4 comprises an exhaust hood 101 generally similar to the hood 1 of FIGS. 1–3, with upwardly converging walls 102 and with a pair of sloping ducts 103, 104 rising to a junction with a flue 108 which includes a filter section 110 with vibrator 142, a bunker 106 formed by a downward extension of the duct, and the aforementioned blower 109 above the filtering unit. FIG. 4 also diagrammatically illustrates a coke-oven battery with coking chambers 116, a platform 139 (see also FIG. 6) for rails 137 forming a main track for a nonillustrated unloading carriage, and rails 123 constituting a secondary track for a quenching wagon 122 overlain by hood 101. An engine 128, assumed to be of the diesel-powered type, also rides on rails 123 and is linked with wagon 122 through a tow bar 129. The walls 102 of hood 101 are rigidly surrounded by a framework 107 supporting at its longitudinal sides 113, 114, near its front end 111, a pair of wheels 119 which ride on lateral rails formed by bars 125, 126 that are mounted on wagon 122 close to its top as best seen in FIG. 6. The rear end 112 of framework 107 forms a mounting 120 for a pair of wheels 121 engaging rails 123 directly behind wagon 122. The somewhat wider rail-supporting bar 126 on the side facing the coking chambers 116 is in turn supported by a ridge along the free edge of platform 139 as likewise seen in FIG. 6.

Figure 5:
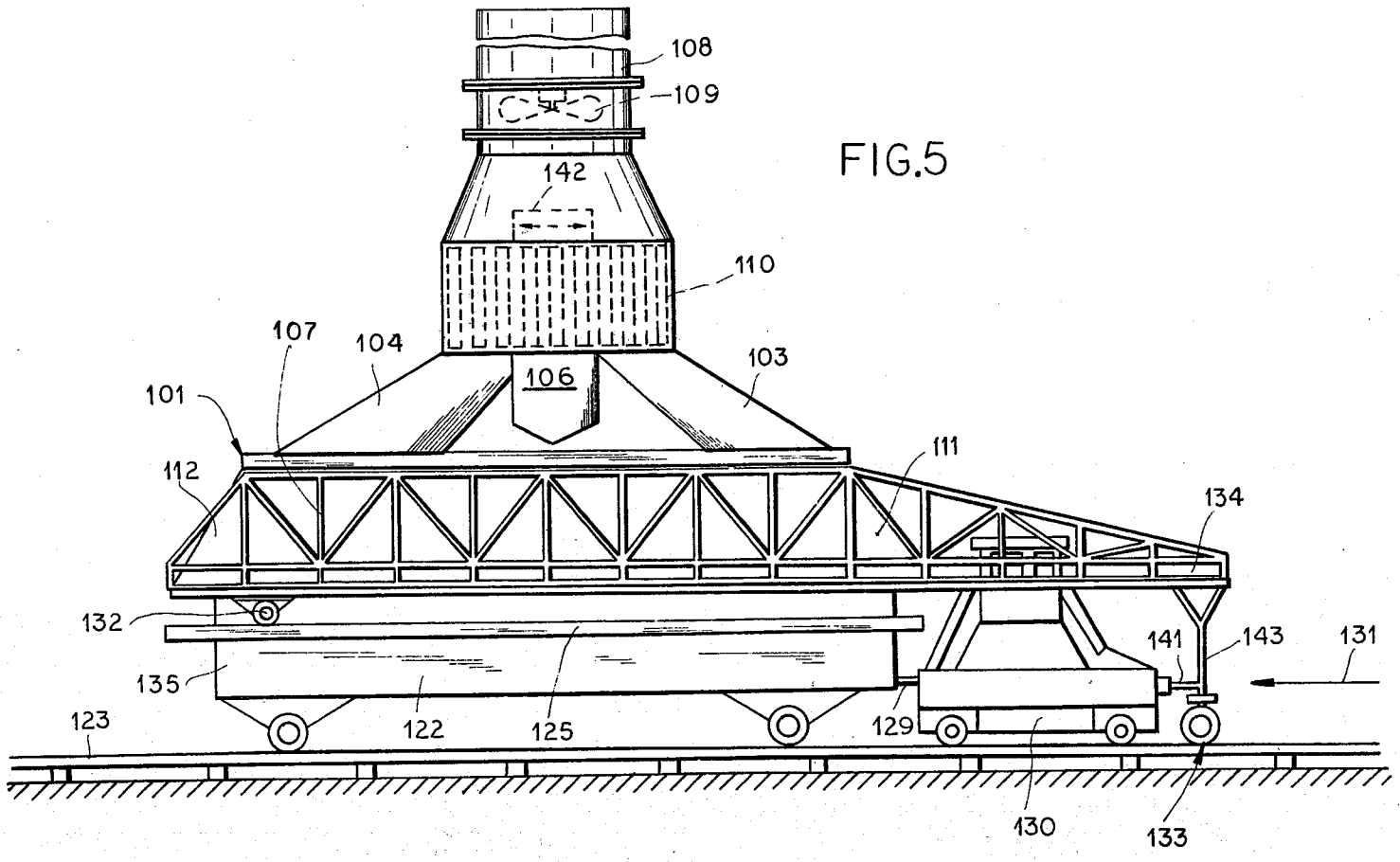
FIG. 5 is a view similar to FIG. 4 but showing a modification of the embodiment of FIG. 4.

During transportation toward the nonillustrated tower of the quenching station in the direction indicated by an arrow 127, hood 101 is positively connected with wagon 122 (e.g. through a link with engine 128 similar to a coupling 141 shown in FIG. 5) so as to occupy the relative position illustrated in FIG. 4. Upon arriving at the entrance of the quenching tower, the hood is decoupled from the wagon 122 and its engine and is arrested, e.g. by brakes engaging the wheels 121, so as to remain outside the tower while the diesel engine 128 pulls the wagon into its interior but only so far that wheels 119 remain in contact with the rails of track 125, 126. Since this will cause the weight of the hood to bear upon the rear end 124 of that track, the front ends of the bars may be engaged inside the tower by rollers bearing upon their upper surfaces to prevent tipping. After the coke bed has been quenched, the engine backs the wagon into realignment with hood 101 for reconnection therewith whereupon the assembly can be transported to a discharge chute before being aligned with another coking chamber for reloading.

The assembly of FIG. 5 differs from that of FIG. 4 in that the engine used for displacing the wagon 122 and its hood 101 is an electric locomotive 130 powered by external conductors of a "third rail" 140 shown in FIG. 6; this Figure also illustrates another set of conductors 140' for powering the motor of an unloading carriage 138 or of an engine towing same on the main track 137. Since it is generally not practical to extend such conductors into a quenching tower, the engine 130 will have to halt in front of that station while remaining connected with the wagon through the tow bar 129. Thus, the assembly of FIG. 5 approaches the quenching tower in the direction indicated by an arrow 131, with the engine pushing instead of pulling; wheels 132 mounted on framework 107 near its rear end 112 ride on track 125, 126 while other wheels 133 engage the rails 123 forwardly of engine 130, these latter wheels being supported on a mounting 143 which descends from a spar 134 forming an outrigger-type forward extension of framework 107. During transportation of the hot coke bed to the quenching station, hood 101 is tied to the engine and thus to the wagon 122 by the aforementioned link 141. As its rear end 112 reaches the tower entrance, link 141 is detached and the hood is arrested (e.g. by brakes acting upon wheels 133) while the engine 130 backs the wagon 122 into the tower. Again, this relative motion of the wagon and the hood is sufficiently limited to let the wheels 132 remain in contact with track 125, 126 during the quenching operation; to prevent tipping, the rear ends of the track-forming bars may be engaged by overlying rollers inside the tower as described for the front ends thereof with reference to FIG. 4.

With a quenching wagon 122 spanning several coking chambers 116, as seen in FIG. 4, it is generally desirable to let that wagon move slowly past the carriage with the hood already in position in order to produce a substantially uniform coke bed thereon.

In order to avoid the need for having the engine and its driver move past an unloading carriage during the discharge of a coking chamber, alternate drive means may be provided for limitedly moving the wagon 122 relatively to hood 101 and independently of the electric engine 130 after the hood has been brought into its unloading position. For this purpose I may use a pair of horizontal conveyor belts forming endless loops on opposite sides of track 123, the belts being provided with dogs engaging in horizontally spaced recesses on the flanks of bars 125 and 126 to move the wagon 122 rearward (in the direction of arrow 131) after a decoupling of tow bar 129 and before the coking chamber is opened, thereafter gradually bringing the wagon back into the position of FIG. 5 for recoupling of the engine. It is also possible to replace the tow bar 129 by a telescoping power shaft, driven by the engine, coupled with a gear transmission inside the wagon.

With the arrangement of FIG. 4 the problem does not arise since the wagon 122 can be moved back and forth relatively to hood 101 by the engine 128 after the hood has been arrested alongside the unloading carriage.

Naturally, two wheel bases respectively engaging track 125, 126 and track 123 as shown in FIGS. 4 and 5 can also be used with a self-propelled quenching wagon.

FIG. 6 also shows pipe sections 151, 152 with coupling 153, auxiliary fan 155 and intake end 156 which are the counterparts of the analogously designated elements of FIG. 2.

I claim:

1. In an unloading assembly for a coke-oven battery wherein a carriage is displaceable on a first track along a row of coking chambers for receiving their charges and transferring same to a quenching wagon displaceable on a second track alongside said first track, the combination therewith of an exhaust hood displaceable above said second track and arrestable in line with a coking chamber for coupling with said carriage in an unloading position thereof via a lateral channel enabling the transfer of a charge to said quenching wagon upon positioning thereof below said hood, an open-topped flue rising above said hood, duct means extending from the top of said hood to a junction with said flue, a dry dust filter disposed in said flue above said junction, and a downward extension of said flue forming a bunker below said junction for receiving solids intercepted by said dust filter, said extension having a normally closed bottom outlet openable to discharge accumulated solids, said quenching wagon being provided with a pair of lateral rails, said hood having first support means at one end with wheels riding said rails and further having second support means at the opposite end with wheels riding said second track, said hood being alternately connectable with and disconnectable from said quenching wagon for positive entrainment thereby and for limited relative displacement.

2. The combination defined in claim 1 wherein said duct means comprises a pair of tubes respectively extending from a front and a rear end of said hood to said flue.

3. The combination defined in claim 1 or 2 wherein said flue is provided with vibratory means periodically operable for shaking said dust filter to dislodge intercepted solids.

4. The combination defined in claim 1 or 2 wherein said hood is provided with a bypass extending in said unloading position above said carriage between said flue and an intake end located above a clearance separating said carriage from an adjoining coking chamber.

5. The combination defined in claim 4 wherein said bypass is divided into two separable parts respectively secured to said hood and to said carriage.

6. The combination defined in claim 1 or 2, further comprising an engine coupled with said quenching wagon for moving same along said second track.

7. The combination defined in claim 6 wherein said second support means comprises an outrigger overhanging said engine, the wheels of said outrigger riding said second track at a location separated by said engine from said quenching wagon.

8. In an unloading assembly for a coke-oven battery, in combination:

a quenching wagon displaceable on a track along a row of coking chambers for receiving their charges from a transfer car in an unloading position and transporting same to a quenching station, said quenching wagon being provided with wheel-guiding means on a level above said track and parallel thereto;

an exhaust hood provided with a flue and filter means in said flue for intercepting dust particles entrained by waste gases from an unloaded charge, said hood being provided at a first end with a first wheel base engaging said wheel-guiding means and at an opposite second end with a second wheel base engaging said track; and drive means coupled with said quenching wagon for displacing same between said unloading position and a quenching station, said hood being connectable with said quenching wagon for entrainment by said drive means toward said quenching station and being disconnectable therefrom at an entrance to said quenching station for enabling said quenching wagon to enter the latter with said charge exposed while said first wheel base remains engaged with said wheel-guiding means.

9. The combination defined in claim 8 wherein said drive means comprises an engine coupled with said quenching wagon at one end thereof.

10. The combination defined in claim 9 wherein said second wheel base is mounted on an extension of said hood overreaching said engine and engages said track at a location separated from said quenching wagon by said engine.

* * * * *